US007909936B2

(12) United States Patent
Lau et al.

(10) Patent No.: US 7,909,936 B2
(45) Date of Patent: Mar. 22, 2011

(54) DISHWASHER FINAL STEAM RINSE METHOD

(75) Inventors: Brooke L. Lau, Saint Joseph, MI (US); Julio C. Moreira, Stevensville, MI (US); Michelle L. Oakes, Flagstaff, AZ (US); Ryan K. Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 109 days.

(21) Appl. No.: 12/339,827

(22) Filed: Dec. 19, 2008

(65) Prior Publication Data

US 2010/0154830 A1 Jun. 24, 2010

(51) Int. Cl.

| | |
|---|---|
| ***B08B 7/04*** | (2006.01) |
| ***B08B 3/02*** | (2006.01) |
| ***B08B 3/04*** | (2006.01) |
| ***B08B 3/10*** | (2006.01) |

(52) U.S. Cl. ..... 134/30; 134/18; 134/19; 134/25.2

(58) Field of Classification Search ..... 134/18, 134/25.2, 30

See application file for complete search history.

(56) References Cited

U.S. PATENT DOCUMENTS

| | | | | |
|---|---|---|---|---|
| 3,049,133 | A * | 8/1962 | Jacobs | 134/57 D |
| 3,049,450 | A | 8/1962 | Koons et al. | |
| 3,586,011 | A | 6/1971 | Mazza | |
| 4,096,872 | A * | 6/1978 | Herbst et al. | 134/105 |
| 4,246,916 | A | 1/1981 | Fay et al. | |
| 4,279,384 | A | 7/1981 | Yamamoto | |
| 4,366,005 | A | 12/1982 | Oguri et al. | |
| 4,457,323 | A * | 7/1984 | Fay et al. | 134/18 |
| 6,422,180 | B1 | 7/2002 | Yiu | |

FOREIGN PATENT DOCUMENTS

| | | | |
|---|---|---|---|
| DE | 4034380 | A1 | 4/1992 |
| DE | 4233936 | A1 | 4/1994 |
| DE | 102004048091 | A1 | 4/2006 |
| EP | 0291713 | A1 | 11/1988 |
| JP | 2002300995 | A | 10/2002 |
| JP | 2006314667 | A | 11/2006 |
| JP | 2006345928 | A | 12/2006 |
| JP | 2007075249 | A | 3/2007 |
| JP | 2007130143 | A | 5/2007 |
| WO | 97/20493 | A1 | 6/1997 |
| WO | 2004/023967 | A1 | 3/2004 |
| WO | 2006/129963 | A2 | 12/2006 |

* cited by examiner

*Primary Examiner* — Michael Kornakov
*Assistant Examiner* — Natasha Campbell
(74) *Attorney, Agent, or Firm* — Robert A. Bacon; Diederiks & Whitelaw PLC

(57) ABSTRACT

An overall dishwasher operation cycle includes a washing cycle and a final rinse cycle including steam generation. During the final rinse cycle, a dishwasher tub is filled with fluid, heated and utilized to rinse dishware within the dishwasher. After partially draining the tub, a heating element is actuated so as to transform fluid in the tub into steam for cleansing dishware within the dishwasher. After the steam cycle, the final rinse cycle is completed, with the dishwasher being drained. Optionally, when a heated dry cycle is actuated, the heating element continues to operate to provide drying heat to dishware for a period of time before being deactivated. With this arrangement, a single heating element is utilized for heating washing fluid for washing, rinsing and steam generation, as well as for the heated dry cycle.

17 Claims, 3 Drawing Sheets

DISHWASHER FINAL STEAM RINSE METHOD

BACKGROUND OF THE INVENTION

1. Field of the Invention

The present invention pertains to the art of dishwashing, and more particularly, to a steam sanitation method for a dishwasher.

2. Description of the Related Art

Maintaining a high sanitation level in connection with the washing of dishes has been a long standing priority in commercial settings. However, the public has also become particularly concerned with minimizing the presence of germs in the home such that it is increasingly desirable to include sanitation options in domestic dishwashers. Typically, performing a sanitation operation in connection with a domestic dishwasher constitutes controlling a heating element during an overall washing cycle such that the washed dishware will be subject to high temperature washing, drying and sanitizing operations. To further address enhance the degree to which dishware is cleaned, it has also been proposed to introduce steam into a dishwashing tub. Basically, steam has been utilized in dishwashers in order to aid in the removal of food debris from dishware. One such known dishwasher arrangement, as set forth in International Patent Application No. WO 2006/129963, incorporates a dedicated steam generator into the dishwasher, with the steam generator directing steam through pipes into a wash chamber containing the dishware.

Although the addition of steam can be advantageous, the requirement for additional components in a domestic dishwasher can add significantly to the manufacturing cost. In addition to the added component costs, the effectiveness of the added use of steam can greatly vary depending on both the manner in which the steam is provided and the time at which the steam is introduced in the overall washing cycle. Based on at least these reasons, it is considered desirable to effectively incorporate steam as part of an overall dishware cleaning strategy in a dishwasher, particularly in connection with a sanitation operation in a dishwasher, while avoiding the costs associated with the need for dedicated steam generating components.

SUMMARY OF THE INVENTION

The present invention is directed to a steam purge and sanitation method for a dishwasher. In general, the dishwasher includes a tub defining a wash chamber, a door movably mounted relative to the tub for selectively sealing the wash chamber, a heating element supported by the tub and exposed to the wash chamber, and a washing assembly for supplying fluid to dishware within the wash chamber. The dishwasher also includes a control panel that allows a consumer to choose between numerous washing cycles and options, including a sanitizing option.

In accordance with the invention, it is desired to provide a steam cleaning operation as part of an overall dishwasher cycle, particularly when the sanitize option is selected. When the sanitize option is initiated, a main washing cycle is performed wherein washing fluid is introduced into the tub to a level substantially at or preferably above the heating element, the washing fluid is heated by activation of the heating element, and the heated washing fluid is distributed throughout the wash chamber via the washing assembly. Thereafter, the tub is drained. Preferably, the washing fluid has a minimum temperature of approximately 145° F. This washing cycle may be repeated multiple times, depending on the type of washing cycle selected by the consumer. Next, a purge cycle is actuated, wherein the tub is filled with water, and the water used to flush or purge the washing assembly before the tub is drained. After purging, one or more rinse cycles are actuated, wherein the tub is filled with water, heated by the heating element and utilized to rinse dishware within the wash chamber. Preferably, the rinse water has a minimum temperature of approximately 156° F. In accordance with the invention, during a final rinse cycle, fluid within the tub is partially drained to below the level of the heating element and the heating element is actuated to transform some of the fluid into steam which is dispersed within the wash chamber. After a predetermined period of time, a final drain of the tub occurs. When the heated dry option is selected, the heating element continues to operate for a period of time after the final drain has occurred in order to provide a drying heat to dishware within the dishwasher. If the heated dry option is not selected, the heating element will be deactivated after the steam generation step.

With this arrangement, the same heating element effectively utilized for heating the washing fluid, heating rinse water, and drying the dishware is employed to generate the desired steam such that a very cost effective arrangement is established. In addition, by linking the steam generation with the final rinse and possibly the heated dry option, the overall cycle time is not substantially increased and the steam is provided at an effective time in the overall dishwashing cycle. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
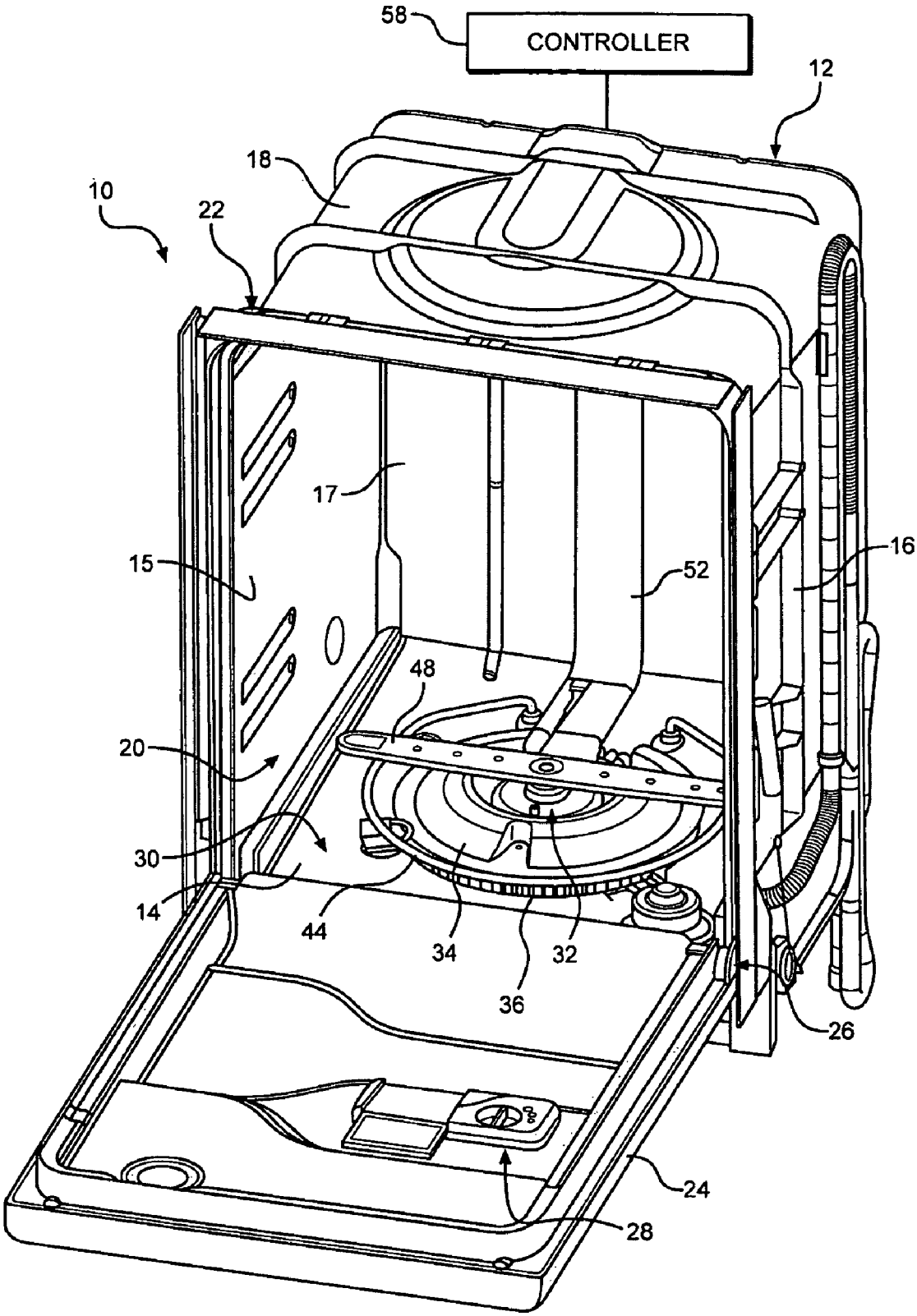
FIG. 1 is an upper right perspective view of a dishwasher utilized in conjunction with the present invention, with a door of the dishwasher being open.

With initial reference to FIG. 1, a dishwasher for use with the present invention is indicated at 10. As shown, dishwasher 10 includes a tub 12 which is preferably injection molded of plastic or formed of stainless steel so as to include integral bottom, side, rear and top walls 14-18 respectively. Within the confines of walls 14-18, tub 12 defines an interior 20 within which soiled kitchenware or dishware is adapted to be placed, such as upon shiftable upper and lower racks (not shown), with the kitchenware being cleaned during a washing operation in a manner widely known in the art. Tub 12 has attached thereto a frontal frame 22 which pivotally supports a door 24 used to create a seal during a washing operation. As shown, door 24 is pivotally supported to frame 22 at a bottom portion 26. In connection with the washing operation, door 24 is preferably provided with a detergent tray assembly 28 within which a consumer can place liquid or particulate washing detergent for dispensing at predetermined portions of the washing operation. Bottom, side and rear walls 14-17 of tub 12, as well as door 24 define a wash chamber indicated at 30 which is adapted to be filled with fluid for washing dishware.

Disposed within wash chamber 30 is a washing assembly generally indicated at 32. In the preferred embodiment and as illustrated in these figures, washing assembly 32 includes a main housing 34, and an annular, radial outermost strainer 36. Extending about a substantial portion of washing assembly 32, at a position raised above bottom wall 14, is a heating element 44. Heating element 44 preferably takes the form of a sheathed, electric resistance-type heating element. In a manner known in the art, washing assembly 32 is adapted to direct washing fluid to at least a lower wash arm 48 and a conduit 52, which leads to an upper spray arm (not shown). See, for example, U.S. Pat. No. 6,997,193, which is hereby incorporated by reference.

Figure 2:
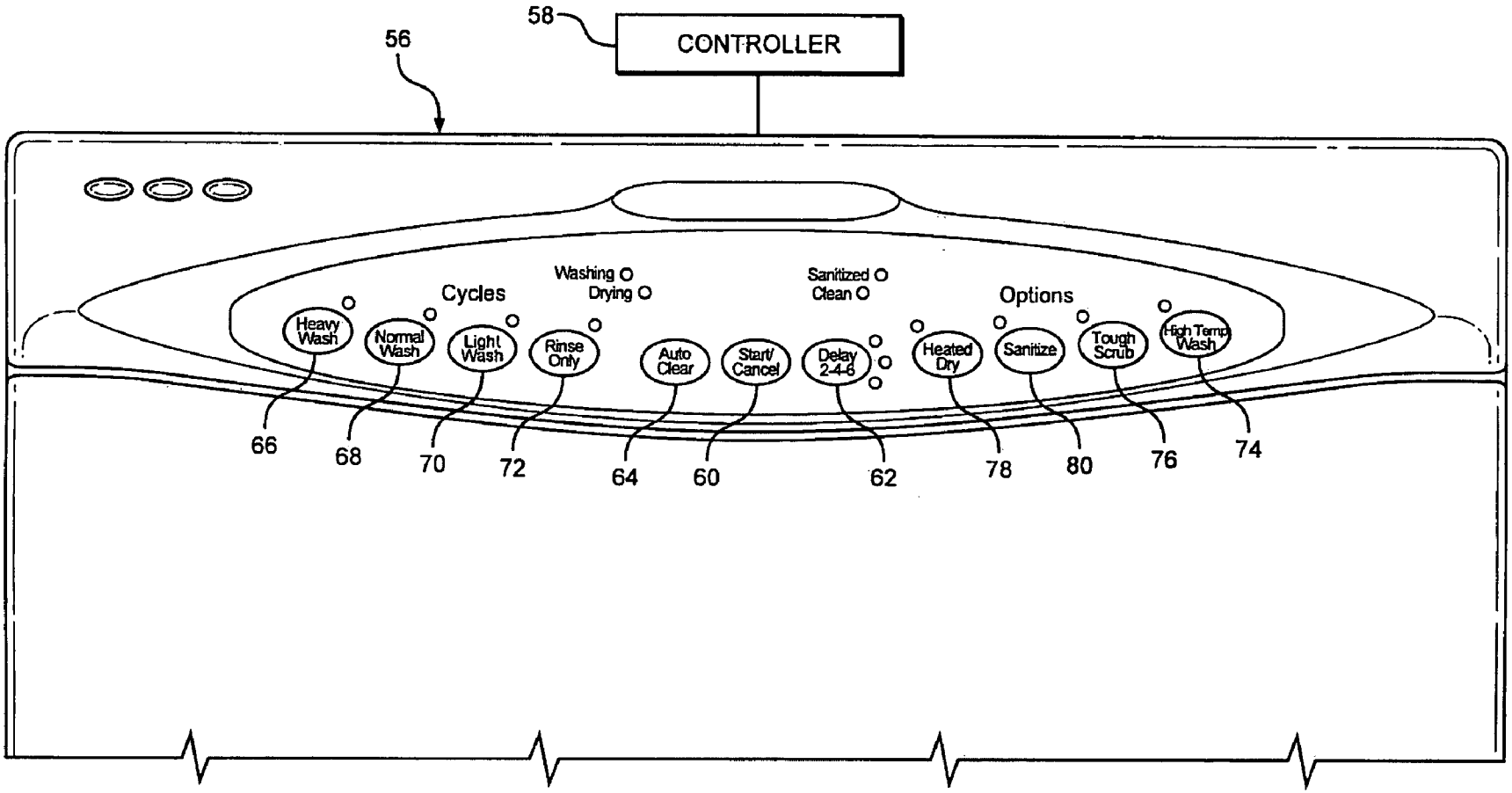
FIG. 2 is a front view of a control panel of the dishwasher of FIG. 1.

As depicted in FIG. 2, a control panel 56 for dishwasher 10 is linked to a controller 58 and provides a user with a variety of washing options. More specifically, control panel 56 preferably includes a start/cancel button 60, a delay programming button 62 and an auto clean button 64. Additionally, control panel 56 preferably includes a plurality of cycle options, such as heavy wash 66, normal wash 68, light wash 70 and rinse only 72, as well as washing options including high temperature wash 74, tough scrub 76 and heated dry 78. In accordance with the present invention, control panel 56 also includes a sanitize option 80 into which the final rinse cycle with steam of the invention is incorporated as will now be described in detail.

Figure 3:
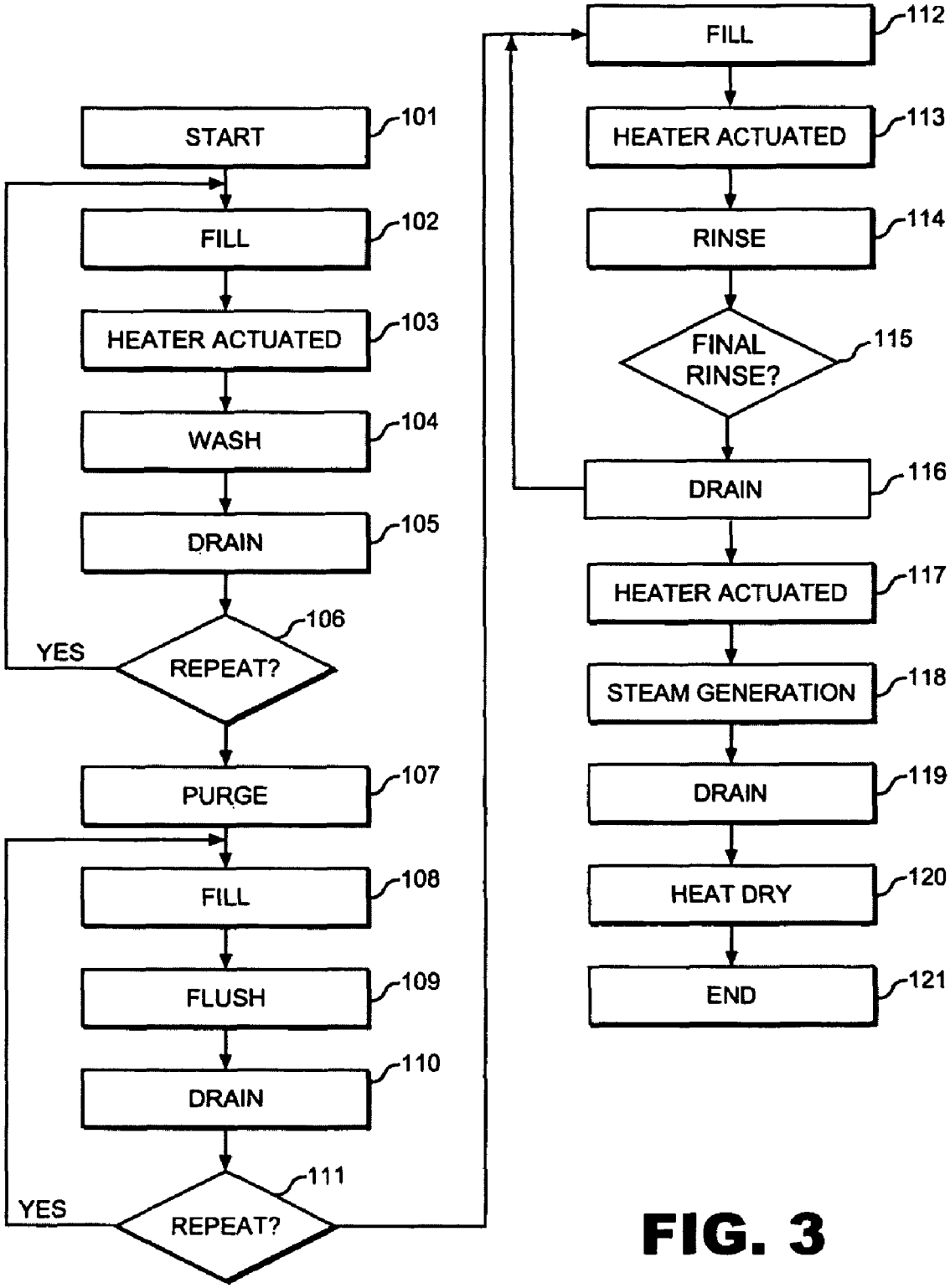
FIG. 3 is a flowchart illustrating the steam sanitation method of the present invention.

With reference to FIG. 3, upon a user selecting a sanitize cycle through button 80 and pushing start/stop button 60 as indicated at 101, a washing cycle is performed wherein wash chamber 30 is initially filled with a washing fluid as indicated at step 102 to a level preferably above heating element 44. The fluid is heated by turning on the wash system and activating heating element 44 at step 103 to circulate the washing fluid over and about heating element 44. When sanitize option 80 is selected, the fluid in wash chamber 30 is preferably heated to a disinfecting temperature of approximately 145° Fahrenheit (° F.), although lower temperatures could be employed as long as the final rinse target temperatures, as discussed below, are met. Washing assembly 32 is then activated and fluid from tub 12 is distributed throughout wash chamber 30 by wash arm(s) 48 and conduit 52 in a manner known in the art to wash dishware within interior 20 as indicated at step 104. The washing fluid is then drained from wash chamber 30 at step 105. As indicated at step 106, steps 102-105 of washing cycle 100 can be repeated if desired, based on the cycle options chosen by the consumer. For example, if heavy wash 66 is selected, steps 102-105 may be repeated two or three times. Next, a purge cycle 107 is initiated, wherein wash chamber 30 is filled with water at step 108, and the water is pumped through wash arm(s) 48 and conduit 52 to flush or purge dishwashing fluid from washing assembly 32 as indicated at step 109. Once this flushing or purging operation is complete, the pump associated with washing assembly 32 is deactivated and the flushed fluid is drained at 110. If desired, multiple, short purge cycles can be performed as indicated at 111. One or more rinse cycles may then be initiated, wherein tub 12 is filled with water to a level substantially at or preferably above heating element 44 at step 112, heating element 44 is activated to heat the rinse water at step 113, then the rinse water is pumped through washing assembly 32 to rinse out wash chamber 30 at step 114. When sanitize option 80 is selected, it is preferred to heat the rinse water to a disinfecting temperature of approximately 156° F. during step 113 for use in rinse step 114.

In accordance with the present invention, it is desired to incorporate a steam generation operation or cycle within a final rinse cycle. Therefore, after rinse step 114, it is determined whether a final rinse cycle has been entered at 115. If the overall dishwashing operation calls for multiple rinse cycles, a drain step 116 follows rinse step 114 and the rinse cycle in steps 112-116 may be repeated. However, during a final rinse cycle, drain step 116 is performed such that tub 12 is only partially drained in order to lower the rinse water level within tub 12 below a level of heating element 44. Thereafter, heating element 44 is activated at step 117 for a predetermined period of time and the rinse water remaining in tub 12 is transformed into high-temperature steam at step 118. During steam generating step 118, steam interacts with dishware within wash chamber 30, effectively loosening any hardened soils and disinfecting the dishware. After a predetermined time period, a final drain of tub 12 is initiated to drain tub 12 of remaining liquid as indicated at 119. At this point, if heated dry option 78 or sanitizing option 80 has been selected, heating element 44 is activated at step 120 after a predetermined drainage period of time. Therefore, heating element 44 continues to be actuated after steam generating step 118 to heat air within wash chamber 30 and expedite drying of dishware therein at step 120 before the overall cycle ends at step 121. Again, the final rinse with steam generation cycle is preferably, automatically performed when a user selects sanitize option 80, and steam generated at step 117 has a temperature effective to disinfect dishware within wash chamber 30.

Based on the above, it should be readily apparent that heating element 44 is advantageously utilized in accordance with the invention for each of the washing, rinsing, steam generating and heat drying operations. Therefore, additional, dedicated steam generating components are not required. For this reason, dishwashers already on the market or in production may be readily programmed in accordance with the method described above and the invention can be implemented in an extremely cost effective manner. In addition, given that the steam generation utilizes fluid already heated during the final rinse step, less energy is need to transform fluids within tub 12 into steam, and energy is conserved. Furthermore, with the steam generation being performed at the end of the final rinse cycle, there will be no more, relatively cool water introduced into tub 12 and circulated over heating element 44 such that there is no risk of thermally shocking heating element 44 and heating element 44 does not have to be allowed to cool before further operations are performed. Thus, the steam generation step can be added without any major modifications or substantial increase in overall cycle time.

Although described with reference to a preferred embodiment of the invention, it should be readily understood that various changes and/or modifications can be made to the invention without departing from the spirit thereof. For instance, although not discussed, the number of purge and rinse cycles prior to the steam cycle may be varied without departing from the invention. Additionally, various pre-wash and pre-rinse cycles may be implemented prior to the washing cycle without departing from the invention. Furthermore, it should be recognized that a user option for steam generation could be directly added on control panel 56 such that the steam generation can be used in connection with other, non-sanitize cycles. Finally, although the invention has been described for use in a more conventional dishwasher arrangement including a pivoting front door, the invention can be employed in a wide range of dishwashers, including drawer dishwashers. In general, the invention is only intended to be limited by the scope of the following claims.

What is claimed is:

1. A method of operating a dishwasher including a tub defining a wash chamber having a bottom wall, a door mounted for movement relative to the tub to selectively close the wash chamber, a heating element supported in the wash chamber above the bottom wall, and a washing assembly for supplying fluid to dishware placed within the wash chamber, the method comprising the steps of:

initiating a washing cycle including at least partially filling the tub with fluid, actuating the heating element to heat the fluid, spraying the heated fluid to the wash chamber through the washing assembly, and draining the tub of fluid; and initiating a final rinse cycle including filling the tub with fluid to a level substantially at or above the heating element, circulating and heating the fluid, rinsing the wash chamber with the heated fluid utilizing the washing assembly, partially draining the tub until the fluid within the tub is at a level below a lower surface of the heating element, actuating the heating element for steam generation within the wash chamber, and subsequently draining the tub in completing the final rinse cycle.

2. The method of claim 1, further comprising: continuing to operate the heating element, after the steam generation is complete in the final rinse cycle, for a period of time to provide a heated dry operation.

3. The method of claim 1, further comprising: automatically performing the steam generation in the final steam rinse cycle in connection with a sanitize cycle of the dishwasher.

4. The method of claim, 3, wherein the fluid is heated during the washing cycle to a temperature of at least 145° F.

5. The method of claim 4, wherein the fluid heated during the final, steam rinse cycle to a temperature of at least 156° F.

6. The method of claim 1, wherein the steam generated has a temperature sufficient to disinfect dishware within the dishwasher.

7. The method of claim 1, further comprising an additional rinse cycle before the final rinse cycle including filling the tub with fluid and heating the fluid, rinsing the wash chamber with the heated fluid utilizing the washing assembly and draining the tub of fluid.

8. The method of claim 1, further comprising: initiating a purge cycle including at least partially filling the tub with fluid, pumping the fluid through the washing assembly and draining the tub of the fluid between the washing cycle and the final rinse cycle.

9. A method of operating a dishwasher including a tub defining a wash chamber having a bottom wall, a door mounted for movement relative to the tub to selectively close the wash chamber, a heating element supported in the wash chamber above the bottom wall, and a washing assembly for supplying fluid to dishware placed within the wash chamber, the method comprising the steps of:

performing a washing cycle wherein washing fluid is sprayed within the wash chamber by operation of the washing assembly for, cleaning the dishware; and performing a final rinse cycle including initiating a rinsing operation wherein the washing chamber is rinsed utilizing the washing assembly, pausing the rinsing operation, partially draining the tub such that the tub is filled to a level below a lower surface of the heating element before performing a steam generation operation, and subsequently completing the final rinse cycle.

10. The method of claim 9, further comprising: initiating a purge cycle to cleanse the washing assembly of the washing, fluid between the washing cycle and the final rinse cycle.

11. The method of claim 10, wherein performing the purge cycle includes at least partially filling the tub with fluid, pumping the fluid through the washing assembly and draining the tub of fluid.

12. The method of claim 9, wherein the steam generation is performed at a temperature effective to disinfect dishware within the wash chamber.

13. The method of claim 9, wherein performing the final rinse cycle includes filling the tub with fluid to a level substantially at or above the heating element, heating the fluid, and rinsing the wash chamber with the heated fluid utilizing the washing assembly.

14. The method of claim 10, further comprising: automatically performing the final rinse cycle and steam generation in connection with a sanitize cycle of the dishwasher.

15. The, method of claim 14, wherein the washing fluid is heated during the washing cycle to a temperature of at least 145° F.

16. The method of claim 15, wherein the rinse fluid is heated during the rinse cycle to a temperature of at least 156° F.

17. The method of claim 9, further comprising the step of initiating a heated dry cycle wherein the heating element is actuated during the final rinse cycle and continues to operate to dry the dishware after steam generation.

* * * * *